US007351268B2

(12) United States Patent
Rae et al.

(10) Patent No.: US 7,351,268 B2
(45) Date of Patent: Apr. 1, 2008

(54) FUEL COMPOSITION

(75) Inventors: Alan Rae, West Sussex (GB); William Hodgson, Marlow (GB)

(73) Assignee: AAE Technologies International PLC, Cork (IE)

( * ) Notice: Subject to any disclaimer, the term of this patent is extended or adjusted under 35 U.S.C. 154(b) by 603 days.

(21) Appl. No.: 10/476,996

(22) PCT Filed: May 13, 2002

(86) PCT No.: PCT/GB02/02109

§ 371 (c)(1),
(2), (4) Date: May 17, 2004

(87) PCT Pub. No.: WO03/002696

PCT Pub. Date: Jan. 9, 2003

(65) Prior Publication Data

US 2004/0231233 A1 Nov. 25, 2004

(30) Foreign Application Priority Data

May 12, 2001 (GB) ..... 0111679.7

(51) Int. Cl.
*C10L 1/18* (2006.01)

(52) U.S. Cl. ..... 44/388; 44/410; 44/437; 44/443

(58) Field of Classification Search ..... 44/385, 44/410, 388, 437, 443
See application file for complete search history.

(56) References Cited

U.S. PATENT DOCUMENTS

| | | | | |
|---|---|---|---|---|
| 3,563,715 | A * | 2/1971 | Barusch et al. | 44/398 |
| 4,204,481 | A * | 5/1980 | Malec | 123/1 A |
| 5,522,906 | A * | 6/1996 | Hashimoto et al. | 44/400 |
| 6,364,918 | B1 * | 4/2002 | Krull et al. | 44/386 |

FOREIGN PATENT DOCUMENTS

| | | | |
|---|---|---|---|
| DE | 4308053 | * | 9/1994 |
| GB | 911491 | A1 | 11/1962 |
| GB | 2 217 229 | A1 | 10/1989 |
| WO | WO-95/33022 | A1 | 12/1995 |
| WO | WO-99/35215 | A2 | 7/1999 |

* cited by examiner

*Primary Examiner*—Cephia D. Toomer
(74) *Attorney, Agent, or Firm*—Darby & Darby P.C.

(57) ABSTRACT

There is described a fuel composition incorporating levulinic acid or a functional derivative thereof.

23 Claims, No Drawings

FUEL COMPOSITION

The use of surfactants as additives for fuels has long been known. Thus, for example, British Patent GB 2 21 72 29 describes an additive which contains 48 parts by volume of an ethoxylated alcohol, 3 to 8 parts of lauric acid diethanolamide, 3 to 8 parts of oleic acid diethanolamide and 1.5 to 4 parts of an ethoxylated oleic acid. Such compositions are suitable as additives which permit the dissolution of water in fuel and thus reduce the corrosion. However, problems arise when, instead of the water, for example short-chain alcohols are to be used as the mixed phase with the fuels. For this purpose, WO 98/17745 describes an alternative composition which contains 25% by volume of diethanolamide, 50% by volume of an ethoxylated alcohol and 25% by volume of a $C_{14}$ fatty acid ethoxylated with 7 mol ethylene oxide per mole of fatty acid. The additive is used for improving the solubility of ethanol in diesel, which in the end results in the reduction in the emissions of $CO_2$ and CO and $NO_x$ and particulate matter (PM) when the fuel is burned in a compression-ignition engine.

As in the past, the disadvantage is that a large number of individual substances have to be used to achieve the desired effect. There has long been a need for achieving dissolution of alcohol in fuel, preferably in diesel, by using economical additives which are as simple as possible, in order to achieve in this way a noticeable reduction in gaseous reaction products of combustion, in particular $NO_x$ and CO or $CO_2$ and PM.

It is an object of the invention to provide a fuel composition which incorporates an additive which (a) provides more oxygen by volume than ethanol or traditional oxygenates such as MTBE or ETBE and (b) gives little or no increase in fuel Reid vapour pressure (RVP) and (c) has little or no effect on the flash point of the base fuel. As a result a fuel composition of this invention will provide significant calorific power with few emissions on combustion in automotive engines, whilst exhibiting low Reid vapour pressure and maintaining the flash point of the base fuel.

According to the invention in one aspect there is provided a fuel composition incorporating levulinic acid, or a functional derivative thereof.

The functional derivative will be one which has no side effects in the context of a fuel composition. Preferably the derivative is an alkyl derivative; preferably one having from 1 to 10 carbon atoms. Preferred is ethyl levulinate. Alternatively, methyl levulinate may be used.

Thus according to one aspect of the invention we provide a fuel composition which is substantially free of alkanolamides, containing at least 95% by volume of a hydrocarbon-based fuel and from 0.1 to 5% by volume of levulinic acid, or a functional derivative thereof A composition of the invention can incorporate hydrocarbon fuels such as gasolines and diesels together with other additives one of which is preferably a blend of non-ionic surfactants including the additive described and claimed in International patent application PCT/GB97/02763 which is incorporated herein by reference.

Furthermore, specific fuel compositions which may be preferred are those disclosed in co-pending International Patent applications Nos. PCT/GB01/04947 and PCT/GB01/04934 which are incorporated herein by reference.

Thus according to one aspect of the invention we provide a fuel composition which is substantially free of alkanolamides, containing at least 95% by volume of a hydrocarbon-based fuel and from 0.1 to 5%. by volume of levulinic acid, or a functional derivative thereof and from 0.1 to 5% by volume of an additive selected from the groups consisting of:

a) the optionally alkoxylated linear or branched saturated or unsaturated monoalcohols having 8 to 24 C atoms, containing zero or 1 to 20 mol of ethylene oxide and/or 1 to 5 mol of propylene oxide per mol of alcohol, or b) the polyols having 2 to 6 carbon atoms, optionally partially esterified with fatty acids having 12 to 24 carbon atoms, or c) the alkoxylated fatty acids having 12 to 24 carbon atoms and 4 to 20 mol of ethylene oxide per mol of fatty acid, or d) the ethoxylated dimeric fatty acids.

In this aspect of the invention, the fuel composition comprises component a).

Component a)

Fatty alcohols are to be understood as a meaning primary aliphatic alcohols of the formula (I)

$$R^1OH \qquad (I)$$

in which $R^1$ represents an aliphatic, linear or branched hydrocarbon radical having 8 to 24 carbon atoms and 0 and/or 1, 2 or 3 double bonds. Typical examples are caproic alcohol, caprylic alcohol, 2-exthylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinly alcohol, linolyl alcohol, linolenyl alcohol elaeostearyl alcohol, arachyl alcohol, gadoleyl alcohol, behenyl alcohol, erucyl alcohol and brassidyl alcohol and their industrial mixtures which are obtained, for example, in the high-pressure hydrogenation of industrial methyl esters based on fats and oils or aldehydes from Roelen's oxo synthesis and as a monomer fraction in the dimerisation of unsaturated fatty alcohols. Industrial fatty alcohols having 12 to 18 carbon atoms, such as, for example, coconut fatty alcohol, paln fatty alcohol, palm kernel fatty alcohol or allow fatty alcohol, are preferred. Oleyl alcohol is particularly preferred. Guerbet alcohols having 12 to 16 carbon atoms are furthermore preferred.

The use of the alkoxylated, preferably ethoxylated and/or propoxylated derivatives of the fatty alcohols of the formula (I) is also particularly preferred. The preparation of these compounds is known and is carried out, for example, by reacting the fatty alcohols in the presence of acidic or basic catalysts with ethylene oxide and/or propylene oxide. Preferred adducts contain 1 to 20 mol of ethylene and/or 1 to 5 mol of propylene oxide per mol of fatty acid. Alkoxylated alcohols which contain 1 to 20 mol of ethylene oxide per mol of fatty alcohol and are free of propylene oxide are particularly preferred. It is furthermore preferable if the radical R represents unsaturated $C_{12-18}$ radical. A fatty alcohol ethoxylated with 8 mol of ethylene oxide is to be regarded as a further particularly preferred compound a).

According to a second aspect of the invention the fuel additive comprises component b).

Component b)

In addition to the mono alcohols, polyols and their esterified derivatives are also suitable additives for the fuel according to the invention. Polyols are organic compounds having 2 to 8 carbon atoms and 2 to 4 hydroxyl functions per molecule. These include, for example, ethylene glycol, propylene glycol, butylene glycol and their oligomers, for example butylene diglycol. Another preferably used polyol is glycerol Furthermore, neopentyl compounds, such as pentaerytritol or trimethylolpropane, are suitable components for group b). The partially esterified derivatives of the polyols, for example glycerol mono-and/or diesters with fatty acids having 8 to 22 carbon atoms, are furthermore preferred. Particularly preferred esters are pentaerytlbrityl esters partially esterified with the fatty acids. Other derivatives, such as ethers, for example diethylene glycol monobutyl ether, are also suitable.

According to a further aspect of the invention the fuel additive comprises component c).

Component c)

The compositions according to the invention contain alkoxylated fatty acids as component c). These fatty acid alkoxylates are known compounds and can be prepared by all methods known to a person skilled in the art. The fatty acid alkoxylates contained in the compositions according to the invention contain exclusively ethylene oxide groups as alkoxides. They preferably contain between 4 and 20 mol of ethylene oxide and in particular 2 to 10 mol of ethylene oxide per mol of ester.

The fatty acid components used are fatty acids have 5 to 30 C atoms and of natural or synthetic origin, in particular straight-chain, saturated or unsaturated fatty acids, including industrial mixtures thereof, as obtainable by lipolysis from animal and vegetable fats and oils, for example from coconut oil, palm kernel oil, soya oil, sunflower oil, colza oil, cottonseed oil, fish oil, beef tallow, and lard; specific examples are caprylic, capric, lauric, lauroleic, myristic, myristoleic, palmitic, palmitoleic, oleic, elaidic, arachic, gadoleic, behenic, and erucic acid.

According to a further aspect of the invention the fuel additive comprises component d).

Component d)

The oligomerisation of unsaturated fatty acids is a known electrocyclic reaction reported in review articles, for example by A. Behr in Fat Sci, Techno. 93, 340 (1991), G. Spiteller in Fac Sci, Technol 94, 41 (1992) or P. Daute et al, in Fat Sci, Technol, 95, 91 (1993). In the oligomerisation, on average two or three fatty acids combine and form dimers or trimers, which have predominantly cycloaliphatic structures. In addition to the fraction comprising the dimers and trimers, a so-called monomer fraction is obtained, which contains unconverted starting materials and branched monomers which have been formed by isomerisation in the course of the reaction. In addition, there is of course also a fraction of higher oligomers which, however, is generally not very important The oligomerisation can be carried out thermally or in the presence of noble metal catalysts. Preferably, the reaction is carried out in the presence of clays, such as, for example, montmorillonite. The content of dimers and trimers or the amount of monomer fraction can be regulated by the reaction conditions. Industrial mixtures can finally also be purified by distillation. Suitable starting materials for the oligomerisation are industrial unsaturated fatty acids having 12 to 22, preferably 16 to 18, carbon atoms. Typical examples are palmitoleic acid, oleic acid, elaidic acid, petroselinic acid, linoleic acid, linolenic acid, conjuenic fatty acid, elaeostearic acid, ricinoleic acid, gadoleic acid, erucic acid, and their industrial mixtures with saturated fatty acids. Typical examples of suitable industrial mixtures are unhydrogenated cleavage fatty acids or natural triglycerides having iodine numbers in the range from 40 to 140, such as, for example, palm oil acid, tallow fatty acid, colza fatty acid, sunflower fatty acid and the like. Cleavage fatty acids having a higher content of oleic acid are preferred.

In addition to the fatty acids, it is possible to dimerise their esters, preferably methyl esters. It is also possible to oligomerise the acid and to convert it into the methyl esters prior to hydrogenation. The conversion of the ester group into the acid group takes place in a manner known per se.

Dimeric fatty acids, which are particularly preferred in the context of the present invention, are obtained by oligomerisation of industrial oleic acid and preferably have a dimer content of 50 to 99% by weight and a polymer content (including trimer content) of 1 to 50% by weight. The content of monomers may be 1 to 15% by weight and, if required, may be reduced by distillation. Dimeric fatty acids which are obtained by oligomerisation are industrial oleic acid and have a dimer content of 70 to 85% by weight, a polymer content of 10 to 20% by weight and a monomer content of 5 to 15% by weight are particularly preferred. The percentages by weight are based on the total amounts of dimeric fatty acid.

The content of the levulinic acid, or a functional derivative thereof, may vary, but may be low, such as from 2 to 5% by volume, an example being about 4% by volume. This is significantly lower than other additives which contain oxygen. Such additives may, however, also be present and examples include water.

According to a further aspect of the invention, the hydrocarbon-based fuel may be substantially alcohol free. Such alcohols are preferentially C1 to C6 alkanols, such as propanol, butanol or ethanol, and isomers thereof. By the term alcohol free we mean, for example, less than 0.01% by volume alcohol.

The fuel compositions according to the invention are prepared by mixing levulinic acid, or a functional derivative thereof and the components a), b), c) or d) individually with a fuel. Preferred fuel compositions are those in which the volume ratio (v/v) of fuel, e.g. petroleum diesel to additive is in the range of 1000:0.5 to 1000:50, and preferably of 1000:1 to 1000:50.

In a preferred embodiment of the invention we provide a fuel composition consisting of 93 to 99.4% by volume of diesel oil from 0.1 to 5% by volume of levulinic acid, or a functional derivative thereof and 0.5 to 2% by volume of an additive a), b), c) or d) according to the above description.

The use of the additives according to the invention makes it possible to prepare mixtures of fuels with levulinic acid as hereinbefore described, preferably petroleum diesel, in an economical manner. Preferably, a maximum of 0.5 to 2.0% by volume of additive are added to the diesel oil/levulinic acid mixture. Water may also be present. water content may be less than 0.2% volume, preferably less than 0.11% by volume.

According to a second aspect of the invention we provide a fuel composition which is substantially free of alkoxylated compounds and is substantially free of long-chain alkyl alcohols having at least 6 C atoms, and contains at least 95% by volume of a hydrocarbon-based fuel, from 0.1 to 5% levulinic acid, or a functional derivative thereof, and 0.1 to 5% by volume of an additive of the formula (I);

$$R—CO—NR^1R^2 \quad (I)$$

in which R is a saturated or unsaturated, linear or branched alkyl radical having 6 to 21 C atoms; and $R^1$ and $R^2$, which may be the same or different, each represent a hydroxyalkyl radical having 1 to 4 C atoms.

In a yet further aspect of the invention the fuel additive may comprise an oleic alkanolamide and an alkoxylated oleic acid.

One advantage of the composition of the invention is that, inter alia, all of the ingredients are substantially or totally miscible, as a result of which, the composition has clarity and long term stability. The use of levilinic acid, or a derivative thereof avoids the necessity to use ethanol as an oxygenator.

In another aspect the fuel is diesel or gasoline. When diesel is present the composition becomes one which is of the type which may also include biodiesel, made from renewable feedstock sources. A suitable composition may contain for example materials such as rape-seed fatty acid methyl esters, soya fatty acid methyl esters, recyclable cooking oils and fats.

International Patent Application No. WO99/35215, Wenzel, describes an additive for combustible fuels which includes a nitrogen source, such as urea. Whilst the additive is said to reduce NOx, the compositions are very complex and include numerous ingredients, including:

a water soluble alcohol,
a C6 to C12 alcohol
a C6 to C18 ethoxylated alcohol
a C10 to C24 fatty acid, and
a nitrogen source.

We have now surprisingly found that.the fuel composition of the invention can comprise very low fuel: additive ratios in combination with nitrogenous compounds, such as urea.

Thus according to the invention we provide a fuel composition as hereinbefore described and a nitrogen source.

The nitrogen compound may be selected from the group consisting of ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl. Urea is preferred. The nitrogen compound may be an anhydrous compound or a hydrous compound, e.g. an aqueous solution, and may be up to a 5% w/w aqueous solution.

According to a yet further feature of the invention we provide a method of solubilising a nitrogen compound in a fuel composition which comprises mixing a hydrocarbon fuel, a nitrogen compound and a fuel additive as hereinbefore described. The method of the invention may optionally include the addition of an alcohol, such as ethanol or water, as hereinbefore described.

We also provide the use of a nitrogen compound in the manufacture of a fuel additive of this aspect of the invention. We especially provide the use of urea in the manufacture of fuel additive of the invention.

In the fuel composition in this aspect of the invention the nitrogen compound may be added by being incorporated into the fuel additive or may be added separately. Furthermore, the nitrogen compound may be added as an aqueous solution.

The fuel composition of the invention may also optionally comprise a cetane booster in amount of from 0.1% v/v to 1.0% v/v, based on the volume of the mixture. When a cetane booster is included in the fuel composition of the invention it may be added as part of the fuel additive of the invention or it may be added separately.

A suitable cetane booster for use in the mixture is selected from the group comprising, 2-ethylhexyl nitrate, tertiary butyl peroxide, diethylene glycol methyl ether, cyclohexanol, and mixtures thereof The amount of cetane booster present in the mixture is a function of the cetane value of the particular diesel fuel and the amount of ethanol present in the particular fuel composition. Generally, the lower the diesel fuel cetane value, the higher the amount of the cetane booster, similarly, because ethanol typically acts as a cetane depressant, the higher the concentration of ethanol in the solution, the more cetane booster may be necessary in the mixture.

The fuel additives of the invention are advantageous in that, inter alia, they are more efficient at producing micro emulsions than prior art additives. Therefore, they are capable of more efficiently producing a stable, clear and homogenous solution with a hydrocarbon fuel, e.g. diesel/ethanol, even in the presence of water. Therefore, according to a further feature of the invention we provide a fuel composition as hereinbefore described, which optionally includes an amount of water, and wherein the fuel consists of a substantially stable, clear and substantially homogeneous solution.

Furthermore, the fuel additive or the fuel composition of the invention may also optionally include a demulsifier in an amount of less than 5% v/v and preferably less than 1% v/v based on the volume of the mixture.

When bio-diesel type fuel is used the properties of fossil-derived diesel fuel are obtained, but there is less pollution. Oxygenated diesels combust in automotive engines to generate less toxic exhaust gases than non-oxygenated diesels such as the oxides of nitrogen, carbon monoxide and particulate matter.

According to a further aspect of the invention we provide a method of running an internal combustion engine comprising the use of a fuel composition as hereinbefore described.

We also provide the use of levulinic acid, or a functional derivative thereof, in the manufacture of a fuel composition as hereinbefore described.

Blends of ethanol as oxygenate with gasoline, whilst improving combustion of the hydrocarbons and reducing toxic gas emissions, exhibit increased Reid vapour pressure. Such increases are undesirable in that the RVP of the blend may exceed the limits specified for commercial automotive fuels for example 7.0 psi in the USA Environmental Protection Agency specification when tested according to ASTM D 5191-99.

Blending of gasoline with levulinic acid or derivatives such as esters produces oxygenated fuels with RVP similar to that of the base gasoline. Low RVP blends are specified during the warmer seasons and the ability to produce oxygenated gasoline without increasing RVP opens up further blending options for the refinery.

Diesels can be blended with ethanol as oxygenate to produce oxygenated diesels which combust more effectively than the base diesels in compression ignition engines and give lower yields of toxic emissions on combustion. However, such blends exhibit flash points similar to that of ethanol i.e. typically 15° C., and consequently they require handling and storage in a similar way to gasoline fuels.

When levulinic acid or derivatives are blended in as oxygenate with diesels, the flash point of the blends remains un-affected and such oxygenated diesels can be handled and stored in the same way as diesels.

The foregoing is illustrated by the following examples.

Testing Protocols

Gasolines

ASTM Standard D 5191-99 describes the standard test for determining the vapour pressure of petroleum products by the Reid method. In the USA, the Environment Protection Agency specifies 7 psi as the maximum allowable RVP in gasoline fuels. In Europe, EN228:2000 specifies a maximum RVP of 60-70 kPa in summer.

Specification gasoline blends containing up to 5.0% ethyl levulinate, 1.0% water and 2.0% non-ionic surfactant were found to have similar RVPs to the base gasoline.

Diesels

ASTM D93 describes the standard test method for determining the Flash Point of fuels. The minimum flash point required to comply with the US Specification ASTM D975 for diesel fuels is 52° C. for No.2 diesel and 38° C. for No.1 diesel. In Europe, EN590 specifies a minimum of 55° C.

Specification diesel blends containing up to 5.0% ethyl levulinate, 1.0% water and 2.0% non-ionic surfactant were found to have similar flash points to the base diesel.

The invention claimed is:

1. A fuel composition comprising levulinic acid, or a functional derivative thereof, as an oxygenate in the fuel composition, wherein the fuel composition is substantially free of alkanolamides and wherein the composition contains 92-97.5% by volume of gasoline and from 2-5% by volume of ethyl levulinate, and 0-1% water and from 0.5-2% by volume of an additive selected from the groups consisting of: a) an alkoxylated linear or branched saturated or unsaturated monoalcohols having 8 to 24 C atoms, containing zero or 1 to 20 mol of ethylene oxide and/or 1 to 5 mol of propylene oxide per mol of alcohol or b) polyols having 2 to 6 carbon atoms, optionally partially esterified with fatty acids having 12 to 24 carbon atoms, or c) alkoxylated fatty acids having 12 to 24 carbon atoms and 4 to 20 mol of ethylene oxide per mol of fatty acid, or d) ethoxylated dimeric fatty acids.

2. A composition according to claim 1 wherein the component a) is selected from the group of primary aliphatic alcohols of the formula (I)

$$R^1OH \quad (I)$$

in which $R^1$ represents an aliphatic, linear or branched hydrocarbon radical having 8 to 24 carbon atoms and 0 and/or 1, 2 or 3 double bonds.

3. A fuel composition according to claim 2 wherein the primary aliphatic alcohol is selected from the group caproic alcohol, caprylic alcohol, 2-exthylhexyl alcohol, capric alcohol, lauryl alcohol, isotridecyl alcohol, myristyl alcohol, cetyl alcohol, paimoleyl alcohol, stearyl alcohol, isostearyl alcohol, oleyl alcohol, elaidyl alcohol, petroselinly alcohol, linolyl alcohol, linolenyl alcohol, elaeostearyl alcohol, arachyl alcohol, gadoleyl alcohol, behenyl alcohol, crucyl alcohol and brassidyl alcohol.

4. A fuel composition according to claim 2 wherein the primary aliphatic alcohol is selected from the group coconut fatty alcohol, palm fatty alcohol, palm kernel fatty alcohol or tallow fatty alcohol.

5. A fuel composition according to claim 2 wherein the primary aliphatic alcohol is oleyl alcohol.

6. A fuel composition according to claim 2 wherein the primary aliphatic alcohol is one or more of the Guerbet alcohols having 12 to 16 carbon atoms.

7. A fuel composition according to claim 1 wherein the component b) is selected from the group including ethylene glycol, propylene glycol, butylene glycol and their oligomers, for example butylene diglycol.

8. A fuel composition according to claim 1 wherein component b) is glycerol.

9. A fuel composition according to claim 1 wherein the component b) is selected from the group including neopentyl compounds, such as pentaerythritol or trimethylolpropane.

10. A fuel composition according to claim 1 wherein the component b) is selected from the group including the glycerol mono-and/or diesters with fatty acids having 8 to 22carbon atoms.

11. A fuel composition according to claim 1 wherein the component b) is selected from the group including pentaerytlrityl esters partially esterified with the fatty acids.

12. A fuel composition according to claim 1 wherein the component b) is a diethylene glycol monobutyl ether.

13. A fuel composition according to claim 1 wherein the component c) is selected from the group including ethylene oxide groups as alkoxides.

14. A fuel composition according to claim 13 wherein the component c) contains between 4 and 20 mol of ethylene oxide.

15. A fuel composition according to claim 14 wherein the component c) contains 2 to 10 mol of ethylene oxide per mol of ester.

16. A fuel composition according to claim 1 wherein the fatty acid components of component c) are fatty acids having 5 to 30 C atoms and of natural or synthetic origin, in particular straight-chain, saturated or unsaturated fatty acids, including industrial mixtures thereof, as obtainable by lipolysis from animal and vegetable fats and oils, for example from coconut oil, palm kernel oil, soya oil, sunflower oil, colza oil, cottonseed oil, fish oil, beef tallow, and lard; specific examples are caprylic, capric, lauric, lauroleic, myristic, myristoleic, palmitic, palmitoleic, oleic, elaidic, arachic, gadoleic, behenic, and erucic acid.

17. A fuel composition according to claim 1 wherein the component d) is selected from dimers of the group palmitoleic acid, oleic acid, elaidic acid, petroselmic acid, linoleic acid, linolenic acid, conjuenic fatty acid, elaeostearic acid, ricinoleic acid, gadoleic acid, erucic acid, and their industrial mixtures with saturated fatty acids.

18. A fuel composition according to claim 1 wherein the component d) is selected from dimers of the group, palm oil acid, tallow fatty acid, colza fatty acid and sunflower fatty acid.

19. A fuel composition according to claim 1 wherein the component d) is a dimer of oleic acid.

20. A fuel composition according to claim 1 further including a nitrogen compound selected from the group consisting of ammonia, hydrazine, alkyl hydrazine, dialkyl hydrazine, urea, ethanolamine, monoalkyl ethanolamine, and dialkyl ethanolamine wherein alkyl is independently selected from methyl, ethyl, n-propyl or isopropyl.

21. A fuel composition according to claim 1 further including a cetane booster.

22. A fuel composition according to claim 21 wherein the cetane booster is selected from the group comprising, 2-ethylhexyl nitrate, tertiary butyl peroxide, diethylene glycol methyl ether, cyclohexanol, and mixtures thereof.

23. A fuel composition according to claim 1 further including a demulsifier.

* * * * *